United States Patent [19]

Maina

[11] Patent Number: 4,632,154

[45] Date of Patent: Dec. 30, 1986

[54] WEFT FEEDER FOR WEAVING LOOMS

[75] Inventor: Bruno Maina, Valdengo, Italy

[73] Assignee: Roj Electrotex S.p.A., Biella, Italy

[21] Appl. No.: 738,383

[22] Filed: May 28, 1985

[30] Foreign Application Priority Data

Jun. 4, 1984 [IT] Italy ..... 22055/84[U]

[51] Int. Cl.[4] ..... D03D 47/36

[52] U.S. Cl. ..... 139/452; 242/47.01

[58] Field of Search ..... 139/452; 242/47.01, 242/47.12, 47.13; 384/447

[56] References Cited

U.S. PATENT DOCUMENTS

| | | | |
|---|---|---|---|
| 4,035,044 | 7/1977 | Miyazaki | 384/447 |
| 4,452,402 | 6/1984 | Ghiardo | 242/47.01 |
| 4,458,729 | 7/1984 | Brouwer | 139/452 |
| 4,498,639 | 2/1985 | Deborde | 242/47.01 |

FOREIGN PATENT DOCUMENTS

| | | | |
|---|---|---|---|
| 2839437 | 8/1979 | Fed. Rep. of Germany | 139/452 |
| 1434497 | 5/1976 | United Kingdom | 242/47.01 |

*Primary Examiner*—Henry S. Jaudon
*Assistant Examiner*—Joseph S. Machuga
*Attorney, Agent, or Firm*—Young & Thompson

[57] ABSTRACT

In a weft feeder for weaving looms, a rotating arm winds a reserve of weft yarn turns around a drum held stationary and structure is provided to move forward the turns on the drum, keeping them mutually spaced. The structure comprises a set of columns, prevented from rotating in respect of said drum, but partially and variably emerging from seats in its periphery, thanks to the motion imparted thereto by the feeder motor shaft, in respect of which they are rotatably mounted by way of a skew bushing and a rotary bearing. This bushing is formed of two hollow bodies, the first of which is keyed to the motor shaft, eccentric in respect of the drum axis, while the second is rotatably mounted on the first, but adopted to be locked thereto in two positions at 180° one in respect of the other and having its outer surface inclined in respect of that axis.

2 Claims, 9 Drawing Figures

WEFT FEEDER FOR WEAVING LOOMS

BACKGROUND OF THE INVENTION

The present invention relates to a weft feeder for weaving looms comprising improved means to accumulate the weft reserve.

It is known that weaving looms using as weft insertion means a carrier other than the shuttle, namely gripper looms, projectile looms and, lastly, air and water looms, require—for a proper working—the weft to be fed therein at a low and most regular tension.

It is also known that, in order to obtain this result, devices called weft feeders, or weft presenting devices, have already been adopted since some time in said looms, said devices being positioned between the bobbin—from which the weft is picked—and the loom insertion means, and forming a weft reserve wound on a drum in the form of successive turns, the unwinding of which takes place at a practically constant tension, the value of which is furthermore adjustable, thanks to a braking system at the outlet of the drum.

The present invention concerns an interesting improvement in weft feeders of the type—since long developed and now generally preferred by loom constructors—wherein the drum around which the weft yarn winds to form the reserve is held stationary, while the turns of said reserve are laid thereon by a rotating aim and are moved forward, mutually spaced, by a set of columns prevented from rotating in respect of said drum, but partially and variably emerging from seats in its periphery, thanks to the composite motion imparted thereto by the feeder motor shaft, in respect of which they are rotatably mounted by way of a skew bushing and a bearing.

As is known to those skilled in the art, the configuration of this system—which will be better described hereinafter—does not allow the reserve of yarn turns to move forward on the drum in both rotation senses of the feeder motor shaft which controls the rotation of the winding reel, as would instead be necessary in order to operate in the twisting sense of the weft yarn being fed, if wishing to prevent—especially during unwinding—the fibres which form said yarn by twisting from falling out of order.

With the above system, in order to adapt the sense of rotation of the weft feeder to the yarn twisting sense, it is in fact necessary not only to reverse the rotation sense of the weft feeder motor, but also to provide for a true and proper disassembly by replacing parts of the mobile columns unit.

This forms a serious limitation for these devices, which need to be partially disassembled whenever the loom is being fed with an article, the yarns of which have a different twist from that of the previous article.

The object of the present invention is to provide a constructive arrangement which avoids having to carry out, in weft feeders of the aforementioned type, the above tiresome disassembly operation when having to change the type of weft yarn used for weaving, and which allows instead adapting the weft feeder to any type of weft yarn, in a simple, convenient and prompt manner, and without having to disassemble any of its parts.

SUMMARY OF THE INVENTION

For this purpose, a weft feeder according to the invention—of the type wherein a rotating reel winds a reserve of weft yarn turns around a drum held stationary, and wherein means are provided to move forward said turns on the drum, keeping them mutually spaced, comprising a set of columns prevented from rotating in respect of said drum, but partially and variably emerging from seats in its periphery, thanks to the motion imparted thereto by the feeder motor shaft, in respect of which they are rotatably mounted by way of a skew bushing and a rotary bearing—is characterized in that, the said bushing is formed of two hollow bodies, the first of which is keyed to the motor shaft, eccentric in respect of the drum axis, while the second is rotatably mounted on the first, but adapted to be locked thereto in two positions at 180° one in respect of the other and having the outer surface inclined in respect of said axis.

The mutual locking between said bodies forming the bushing according to the invention can be obtained by means of a dowel screwed into the first body and adapted to project inwardly therefrom, so as to engage with its ends either of two opposed cavities provided on the second body.

BRIEF DESCRIPTION OF THE DRAWINGS

The invention will now be described in further detail, by mere way of example, with reference to a preferred embodiment thereof, illustrated in the accompanying drawings, in which.

DESCRIPTION OF THE PREFERRED EMBODIMENT

Figure 1:
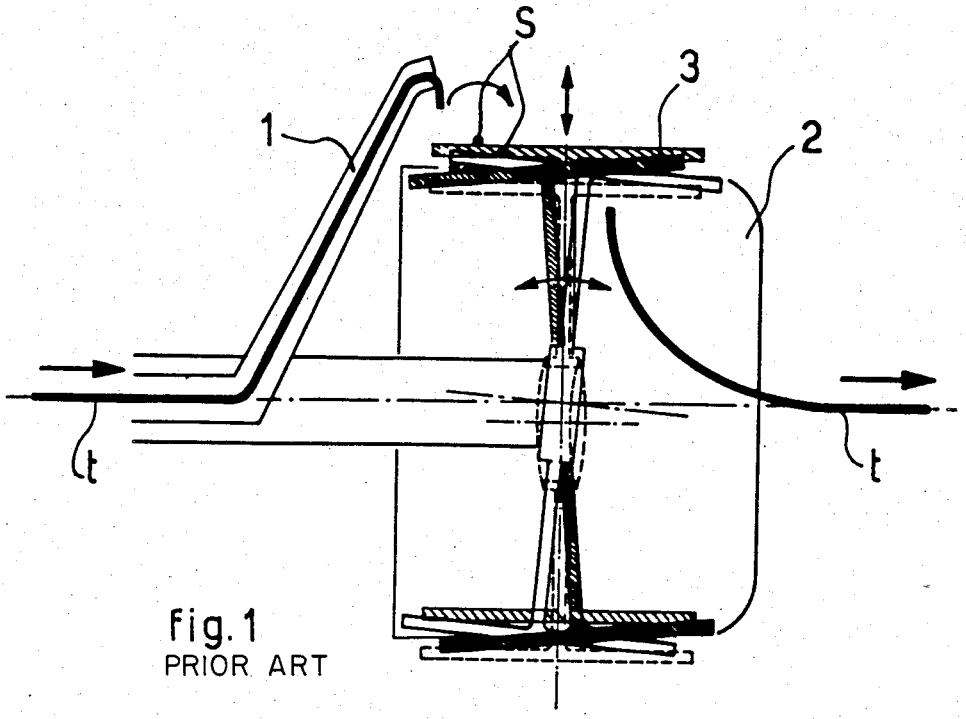
fig. 1 PRIOR ART
FIG. 1 shows schematically a weft feeder (or weft presenting device) of the type wherein the drum is held stationary and the yarn turns of the reserve move forward thereon mutually spaced.

With reference to the accompanying drawings, FIG. 1 is a diagrammatic sectional view of the device for moving forward the yarn turns separately in a weft feeder with drum held stationary, wherein the turns S of yarn t are wound by a rotating arm 1 round the drum 2, from which partially and variably emerge mobile columns 3, to which a proper motion is imparted to move forward the turns S laid in succession, keeping them mutually spaced.

Figure 2:
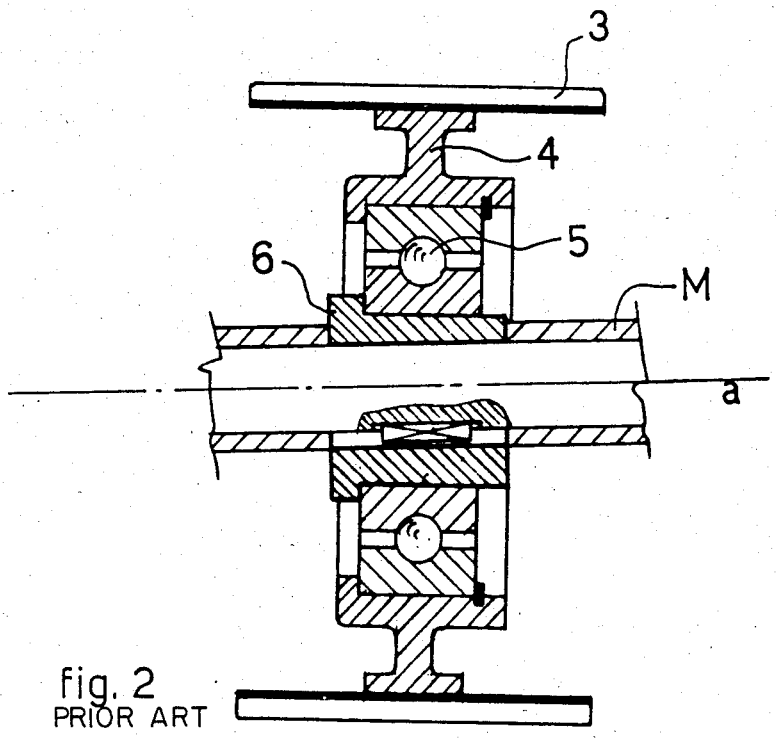
fig. 2 PRIOR ART
FIG. 2 is an axial sectional view, showing the assembly of the columns moving forward said yarn turns in the weft feeder of FIG. 1.
Figure 3A:
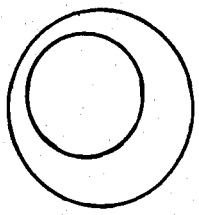
FIG. 3A PRIOR ART
FIGS. 3A through 3D show end and side views of bushings of known construction; used for the assembly illustrated in FIG. 2.
Figure 3B:
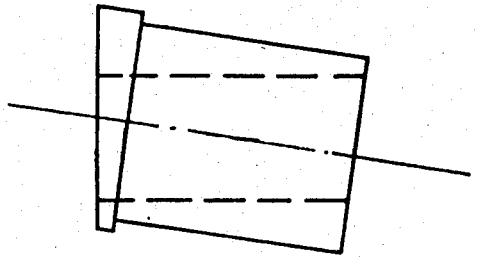
FIG. 3 B PRIOR ART
Figure 3C:
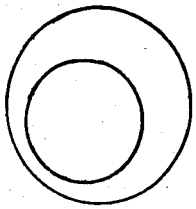
FIG. 3C PRIOR ART
Figure 3D:
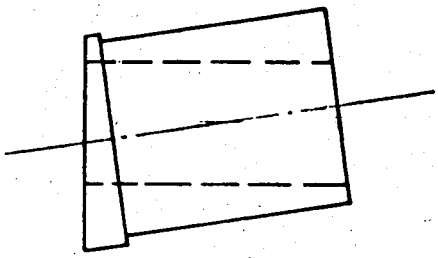
FIG. 3D PRIOR ART

FIG. 2 shows in detail how the mobile columns 3 are carried by supports 4 mounted on a rotary bearing 5, which is in turn keyed onto a bushing 6 fixed to the motor shaft M. In known manner, in order to obtain the desired motion of the mobile columns 3 allowing the weft yarn turns to move forward separately, the outer surface of the bushing 6 has its axis skew in respect of the rotation axis, which coincides with the axis a of the motor shaft M of the feeder.

According to known technique, the bushing 6 should be constructed in two specularly symmetrical types (see FIGS. 3A through 3D), to be used alternatively when feeding weft yarns twisting in one direction or, respectively, in the opposite direction. Thus, when wishing to reverse the rotation direction, to weave a yarn with a different twist from the previous one, the weft feeder has to be disassembled and the bushing 6 of one type has to be replaced by that of other type.

Figures 4A, 4B:
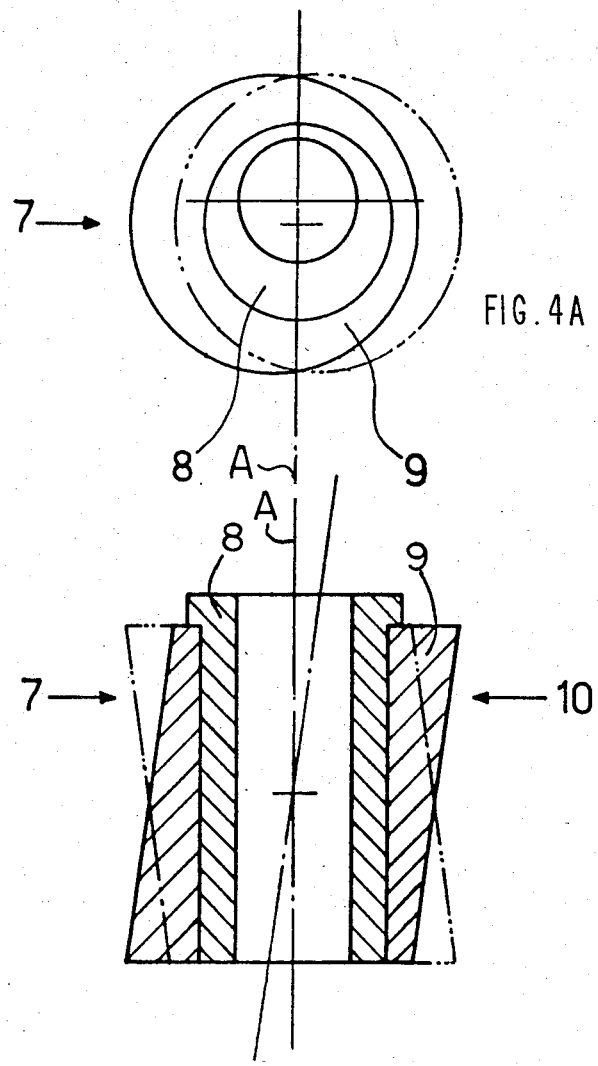
FIGS. 4A and 4B show a front and a sectional view of the improved bushing according to the invention.

To avoid this inconvenience, the present invention provides a bushing 7 formed (FIGS. 4A and 4B) of two concentric bodies 8 and 9. As shown in FIGS. 4A and 4B, the inner body 8 is secured to motor shaft M by key 8*a* and is in turn a bushing, the external cylindrical part of which is eccentric in respect of the central hole, while the outer body 9, mounted with a slight play on the bushing 8, has an external surface 10 with axis inclined in respect of the central axis A.

It ca be easily understood that, by rotating the outer body 9—on which is to be mounted the bearing 5 on which rotates the support 4 of the columns 3—in respect of the inner body 8 which is keyed to the motor shaft M, by an angle of 180°, one obtains the two desired configurations, with opposite inclination, of the composite skew bushing 7 comprising the bodies 8 and 9. FIG. 4 shows one of these configurations in continuous lines, and the other in dashes and dots.

The practical convenience of the invention lies in the essential fact that the 180° rotation and relative locking between the bodies 8 and 9 of the bushing 7 may be easily and rapidly obtained when the weft feeder is already mounted.

Figure 5:
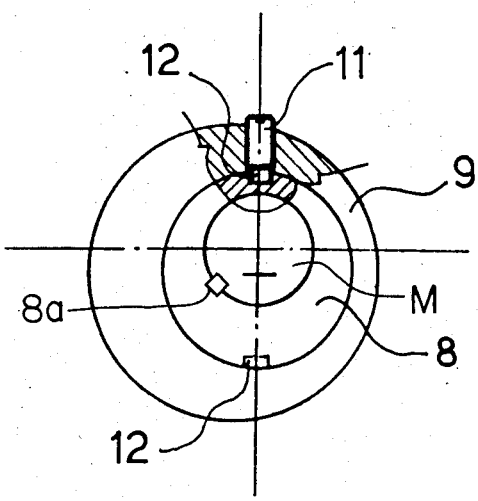
FIG. 5 shows in detail a preferred assembly of the two bodies forming the bushing of FIGS. 4A and 4B.

For this purpose, the outer body 9 can simply be locked (FIG. 5) to the inner body 8 by means of a threaded dowel 11, which is screwed into said body 9 and can project inwardly therefrom to be inserted in either of two cylindrical cavities 12, formed on the external periphery of the inner body and positioned at 180° one in respect of the other.

The relative rotation between the two bodies can be very conveniently obtained by unscrewing the locking dowel 11 and, holding fast the outer body 9 with the tool used to unscrew the dowel, causing the 180° rotation of the inner body 8 by rotating the motor shaft M onto which it is keyed.

The locking is obtained by screwing again the dowel 11, which thereby engages the opposite cavity 12 of the inner body 8.

It is understood that there may be other equally efficient methods for mutually locking the two bodies 8 and 9 forming the bushing 7 according to the invention. For instance, the screw dowel 11 could be replaced by a spring controlled click lever.

I claim:

1. In a weft feeder for weaving looms, of the type wherein a rotating reel winds a reserve of weft yarn turns around a drum held stationary, and wherein means are provided to move forward said turns on the drum, keeping them mutually spaced, said means comprising a set of non rotating columns relative to said drum, said means being further adapted to cause said columns to partially and variably emerge from seats in the periphery of said drum, said means includes a feeder motor shaft, a skew bushing and a rotary bearing mounting said column; the improvement in which said bushing is formed of two hollow bodies, a key by which the first of said hollow bodies is keyed to the motor shaft, said first body being eccentric in respect of the drum axis, while the second body is rotatably mounted on the first body, and means to selectively lock said second body to said first body in one of two positions spaced at 180° in respect of the other, said second body having an outer surface which is cylindrical about an axis and inclined with respect to said drum axis.

2. Weft feeder as in claim 1, wherein said means to lock said bodies is obtained by means of a dowel screwed through said second body and adapted to project therefrom, in order to engage with its inner end either of two opposed cavities provided on the first body.

* * * * *